US012507785B2

(12) United States Patent
Yang

(10) Patent No.: US 12,507,785 B2
(45) Date of Patent: Dec. 30, 2025

(54) PRESS-TYPE MAKEUP PEN

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/806,701

(22) Filed: Aug. 16, 2024

(65) Prior Publication Data

US 2025/0248504 A1 Aug. 7, 2025

(30) Foreign Application Priority Data

Feb. 1, 2024 (CN) ..... 202410146545.7

(51) Int. Cl.
*A45D 40/20* (2006.01)

(52) U.S. Cl.
CPC ..... *A45D 40/205* (2013.01); *A45D 2040/208* (2013.01)

(58) Field of Classification Search
CPC ..... A45D 40/04; A45D 40/06; A45D 40/205; A45D 40/208
USPC ..... 401/62, 69
See application file for complete search history.

(56) References Cited

U.S. PATENT DOCUMENTS

| | | | | |
|---|---|---|---|---|
| 6,155,734 | A * | 12/2000 | Kageyama | A45D 40/20 401/32 |
| 6,244,769 | B1 * | 6/2001 | Nakajima | A45D 40/04 401/75 |
| 11,980,276 | B2 * | 5/2024 | Kuga | A45D 40/205 |
| 2005/0163554 | A1 * | 7/2005 | Cara Sanchez | A45D 40/04 401/75 |

FOREIGN PATENT DOCUMENTS

| | | | |
|---|---|---|---|
| CN | 202354690 | U | 8/2012 |
| CN | 203041100 | U | 7/2013 |
| CN | 106798391 | A | 6/2017 |
| CN | 111513449 | A | 8/2020 |
| CN | 115590292 | A | 1/2023 |

(Continued)

*Primary Examiner* — David P Angwin
*Assistant Examiner* — Bradley S Oliver
(74) *Attorney, Agent, or Firm* — Bayramoglu Law Offices LLC

(57) ABSTRACT

A press-type makeup pen includes a nib assembly, a body assembly, a discharge assembly, and a drive assembly, where the nib assembly includes a sleeve; the discharge assembly includes a material loading member and a threaded rod; the sleeve is rotatably provided in the body assembly; the drive assembly is provided in the body assembly; the material loading member is threadedly connected to the threaded rod; the threaded rod is threadedly connected to the drive assembly; the sleeve can drive the material loading member to rotate synchronously, such that the material loading member moves along an axial direction of the threaded rod to retract into the threaded rod; and the drive assembly can drive the threaded rod to move toward a free end of the sleeve along an axial direction of the sleeve. A button of the drive assembly is provided on a tail portion of the makeup pen.

17 Claims, 14 Drawing Sheets

(56) References Cited

FOREIGN PATENT DOCUMENTS

| | | | |
|---|---|---|---|
| CN | 222017896 | U | 11/2024 |
| JP | 2008212613 | A | 9/2008 |
| WO | 2017217617 | A1 | 12/2017 |
| WO | 2023103561 | A1 | 6/2023 |

* cited by examiner

PRESS-TYPE MAKEUP PEN

CROSS REFERENCE TO THE RELATED APPLICATIONS

This application is based upon and claims priority to Chinese Patent Application No. 202410146545.7, filed on Feb. 1, 2024, the entire contents of which are incorporated herein by reference.

TECHNICAL FIELD

The present disclosure relates to a cosmetic packaging technology, and in particular to a press-type makeup pen.

BACKGROUND

At present, most of existing cosmetics such as lipsticks, lip glosses and eyeliners are discharged in a rotating manner. When used, a base or a rotating portion of the cosmetic container needs to be rotated by a user, thereby driving the cosmetic to reach out of the container. As a result, makeup pens for these cosmetics are operated using two hands, and thus are inconvenient.

SUMMARY

The present disclosure provides a press-type makeup pen, to overcome the above defects. A drive assembly is provided in the makeup pen. The drive assembly includes a button. The button is provided on a tail portion of the makeup pen. A user can press the button with a single hand to realize unidirectional discharge, which is convenient and reduces pollution and waste of the material.

To solve the technical problems, the present disclosure employs the following technical solutions:

A press-type makeup pen includes a nib assembly, a body assembly, a discharge assembly, and a drive assembly, where the nib assembly includes a sleeve; the discharge assembly includes a material loading member and a threaded rod; the sleeve is rotatably provided in the body assembly; the drive assembly is provided in the body assembly; the material loading member is threadedly connected to the threaded rod; the threaded rod is threadedly connected to the drive assembly; the sleeve can drive the material loading member to rotate synchronously, such that the material loading member moves along an axial direction of the threaded rod to retract into the threaded rod; and the drive assembly can drive the threaded rod to move toward a free end of the sleeve along an axial direction of the sleeve.

Optionally, the sleeve is axially fixed and circumferentially movable in the body assembly; and the sleeve can drive the material loading member to move toward the drive assembly.

Optionally, the sleeve is unidirectionally rotatable in the body assembly.

Optionally, the body assembly includes a barrel and a coupling member that are fixedly connected; an elastic tooth is provided on the sleeve; a first oblique surface and a first straight surface are provided on the elastic tooth; a sawtooth is provided on an inner peripheral wall of the barrel; a second oblique surface and a second straight surface are provided on the sawtooth; the first oblique surface can slide on the second oblique surface; and the first straight surface is stopped at the second straight surface.

Optionally, a mounting groove is formed in the sleeve; the elastic tooth is provided in the mounting groove; a first end of the elastic tooth is fixedly connected to the sleeve, and a second end of the elastic tooth is a free end; the first straight surface is located at the second end of the elastic tooth; and the first oblique surface is located on an outer surface of the elastic tooth.

Optionally, the material loading member includes a material loading cylinder and a connecting rod fixed on the material loading cylinder; the material loading cylinder is circumferentially fixed and axially movable in the sleeve; and the connecting rod is threadedly connected to the threaded rod.

Optionally, an outer peripheral wall of the connecting rod is provided with a first external thread; a cavity is formed in the threaded rod; an inner peripheral wall of the threaded rod is provided with a first internal thread, and an outer peripheral wall of the threaded rod is provided with a second external thread; the connecting rod is inserted into the cavity; and the first external thread cooperates with the first internal thread.

Optionally, after the connecting rod retracts into the threaded rod completely, the threaded rod abuts against a bottom of the material loading cylinder.

Optionally, the drive assembly includes a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet can drive the ratchet wheel to rotate; and the ratchet wheel can drive the rotating member to rotate, such that the rotating member drives the threaded rod to move away from the button.

Optionally, a first latch is provided on the ratchet; a second latch and a first pawl are provided on the ratchet wheel; a second pawl is provided on the rotating member; an inner peripheral wall of the rotating member is provided with a second internal thread; the first latch is engaged with the second latch; a gap is formed between two adjacent first pawls; and the second pawl is inserted into the gap to realize synchronous rotation of the rotating member and the racket wheel.

The present disclosure has the following beneficial effects:

(1) According to the present disclosure, the nib assembly includes a sleeve and a cap, and the discharge assembly includes a material loading member and a threaded rod. Since the material loading member is located at the free end of the sleeve before filling, a cosmetic material is filled to the assembled makeup pen conveniently from the front end of the makeup pen. After the filling, by rotating the sleeve, and with threaded connection between the material loading member and the threaded rod, the material loading member retracts into the threaded rod, namely the cosmetic material retracts into the sleeve. Therefore, the operation is very convenient.

(2) According to the present disclosure, the drive assembly includes a button and a rotating member. The button is located at a tail end of the makeup pen. In response to use, the button can be operated by a single hand to realize discharge of the makeup pen, and thus the use is more convenient. In the present disclosure, the threaded rod is connected to the material loading member and the rotating member, which not only can realize loading of the cosmetic material, but also can realize discharge of the cosmetic material. Therefore, the present disclosure simplifies a structure of the makeup pen, and reduces development and manufacturing costs of the makeup pen. In response to use of the present disclosure, only the button in the drive assembly can be operated to discharge the material, and the cosmetic material cannot retract into the sleeve by rotating the sleeve. The present disclosure realizes unidirectional slight discharge, and effectively prevents pollution and waste.

Figure 1:
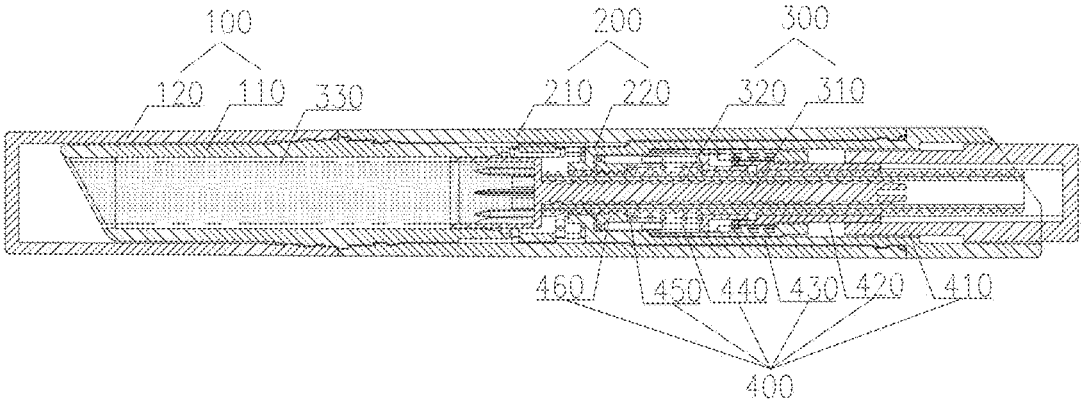
FIG. 1 is a first schematic structural view of a makeup pen according to the present disclosure.

In the figures: 100—nib assembly, 110—sleeve, 111—elastic tooth, 112—first oblique surface, 113—first straight surface, and 120—cap;

200—body assembly, 210—barrel, 211—sawtooth, 212—second oblique surface, 213—second straight surface, and 220—coupling member;

300—discharge assembly, 310—material loading member, 311—material loading cylinder, 312—connecting rod, 313—first external thread, 320—threaded rod, 321—cavity, 322—first internal thread, 323—second external thread, and 330—cosmetic material; and

400—drive assembly, 410—button, 420—ratchet, 421—first latch, 430—ratchet seat, 440—ratchet wheel, 441—second latch, 442—first pawl, 450—elastic member, 460—rotating member, 461—second pawl, and 462—second internal thread.

DETAILED DESCRIPTION OF THE EMBODIMENTS

The following describes the technical solutions in the embodiments of the present disclosure clearly and completely with reference to the embodiments of the present disclosure. Apparently, the embodiments described are merely some rather than all of the embodiments of the present disclosure. All other embodiments obtained by a person of ordinary skill in the art based on the embodiments of the present disclosure without creative efforts shall fall within the protection scope of the present disclosure.

It should be noted that the terms "first", "second" and so on in the description and claims of the present disclosure and in the following accompanying drawings are intended to distinguish similar objects but do not necessarily indicate a specific order or sequence. It should be understood that the objects used in such a way may be exchanged under proper conditions to make it possible to implement the described implementations of the present disclosure in sequences except those illustrated or described herein. Moreover, the terms "include", "have" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent to such a process, method, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Embodiment: As shown in FIGS. 1-19, a press-type makeup pen includes nib assembly 100, body assembly 200, discharge assembly 300, and drive assembly 400. The nib assembly 100 includes sleeve 110. The discharge assembly 300 includes material loading member 310 and threaded rod 320. The sleeve 110 is rotatably provided in the body assembly 200. The drive assembly 400 is provided in the body assembly 200. The material loading member 310 is threadedly connected to the threaded rod 320. The threaded rod 320 is threadedly connected to the drive assembly 400. The sleeve 110 can drive the material loading member 310 to rotate synchronously, such that the material loading member 310 moves along an axial direction of the threaded rod 320 to retract into the threaded rod 320. The drive assembly 400 can drive the threaded rod 320 to move toward a free end of the sleeve 110 along an axial direction of the sleeve 110.

Optionally, the material loading member 310 is inserted into the threaded rod 320, and threadedly connected to the threaded rod. The threaded rod 320 is provided in the drive assembly 400, and threadedly connected to the drive assembly. Cosmetic material 330 is stored in the material loading member 310. The cosmetic material 330 may be a lipstick, an eye shadow, a lip gloss, a lip cream, an eyeliner cream, a sunscreen stick, a body balm or a deodorant stick. When the drive assembly 400 drives the threaded rod 320 to move, the threaded rod 320 drives the material loading member 310 to move synchronously along the axial direction of the sleeve 110, such that the cosmetic material 330 reaches out of the sleeve 110 for use. It is to be noted that the threaded rod 320 and the material loading member 310 keep relatively static without relative rotation. In this case, the threaded rod 320 and the material loading member 310 can be considered as a whole of the discharge assembly 300 to serve as a mechanical structure in the entire press-type makeup pen. A moving direction of the material loading member 310 under an action of the sleeve 110 is opposite to a moving direction of the material loading member 310 under an action of the threaded rod 320. Optionally, the nib assembly 100 further includes cap 120. The cap 120 is sleeved on the sleeve 110 in a pluggable manner.

Figure 2:
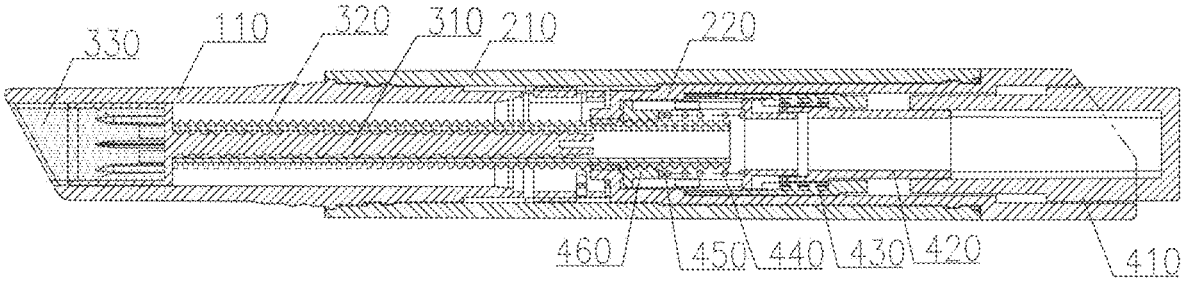
FIG. 2 is a second schematic structural view of a makeup pen according to the present disclosure.
Figure 13:
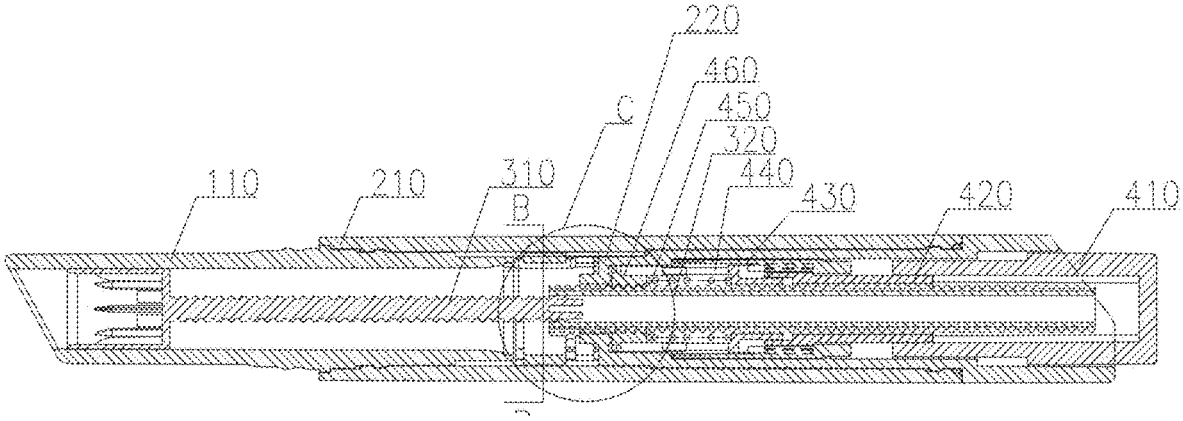
FIG. 13 is a schematic structural view before a makeup pen is filled according to the present disclosure.

As shown in FIG. 1 and FIG. 2, the free end of the sleeve 110 is an open end. The free end of the sleeve 110 is located outside the body assembly 200. A rear end of the sleeve 110 is located in the body assembly 200. The rear end of the sleeve 110 is close to the drive assembly 400. As shown in FIG. 13, after the makeup pen is assembled completely, the material loading member 310 is located in the sleeve 110, and the material loading member 310 is close to the free end of the sleeve 110. The cosmetic material 330 such as the lipstick is pressed into the sleeve 110 through the open end of the sleeve 110, thereby completing filling. Then, the sleeve 110 is rotated by the operator or the manipulator. The sleeve 110 drives the material loading member 310 to rotate synchronously. Since the material loading member 310 is threadedly connected to the threaded rod 320, the material loading member 310 in rotation can move axially relative to the threaded rod 320, until a state shown in FIG. 16, namely the material loading member 310 retracts into the threaded rod 320 to the maximum extent. At last, the cap 120 is provided, thereby completing a filling process of the makeup pen. According to the present disclosure, since the material loading member is located at the free end of the sleeve, the cosmetic material is filled to the assembled makeup pen conveniently from the front end of the makeup pen. After the filling, by rotating the sleeve, and with threaded connection between the material loading member and the threaded rod, the material loading member retracts into the threaded rod, and the cosmetic material retracts into the sleeve. Therefore, the operation is very convenient.

When the press-type makeup pen filled with the cosmetic material or the skincare material is used, under an action of the drive assembly 400, the threaded rod 320 drives the material loading member 310 to move synchronously along the axial direction of the sleeve 110, such that the cosmetic material reaches out of the sleeve for use. In the present disclosure, the drive assembly can be operated by a single hand to realize discharge of the makeup pen, and thus the use is more convenient. In the present disclosure, the threaded rod is connected to the material loading member and the drive assembly, which not only can realize loading of the cosmetic material, but also can realize discharge of the cosmetic material. Therefore, the present disclosure simplifies a structure of the makeup pen, and reduces development and manufacturing costs of the makeup pen.

As shown in FIG. 1, the sleeve 110 is axially fixed and circumferentially movable in the body assembly 200. The sleeve 110 can drive the material loading member 310 to move toward the drive assembly 400. In a possible implementation, the structure in which the sleeve 110 is axially fixed and circumferentially movable in the nib assembly 200 is as follows: An outer peripheral wall of the sleeve 110 is circumferentially provided with a first snap ring. An inner peripheral wall of the body assembly 200 is circumferentially provided with a second snap ring. The first snap ring is attached to the second snap ring, such that the sleeve 110 can rotate relative to the body assembly 200. However, the sleeve 110 cannot move axially relative to the body assembly 200.

In another possible implementation, the structure in which the sleeve 110 is axially fixed and circumferentially movable in the nib assembly 200 is as follows: An outer peripheral wall of the sleeve 110 is circumferentially provided with a first snap ring. A clamping groove configured to clamp the first snap ring is formed in an inner peripheral wall of the body assembly 200. Alternatively, the inner peripheral wall of the body assembly 200 is circumferentially provided with the first snap ring. The clamping groove configured to clamp the first snap ring is formed in the outer peripheral wall of the sleeve 110. Through cooperation between the first snap ring and the clamping groove, the sleeve 110 can rotate relative to the body assembly 200. However, the sleeve 110 cannot move axially relative to the body assembly 200.

Optionally, the sleeve 110 is unidirectionally rotatable in the body assembly 200. That is, the sleeve 110 can only rotate clockwise or counterclockwise relative to the body assembly 200, such that the material loading member 310 can only move toward the drive assembly 400. Only after the cosmetic material 330 is pressed into the sleeve, rotating the sleeve 110 makes the cosmetic material 330 retract into the sleeve. In response to use, rotating the sleeve 110 cannot make the cosmetic material 330 reach out of or retract into the sleeve, and the cosmetic material can only be discharged through the drive assembly 400. This effectively prevents the cosmetic material from discharging for a misoperation to cause pollution and waste.

Figure 5:
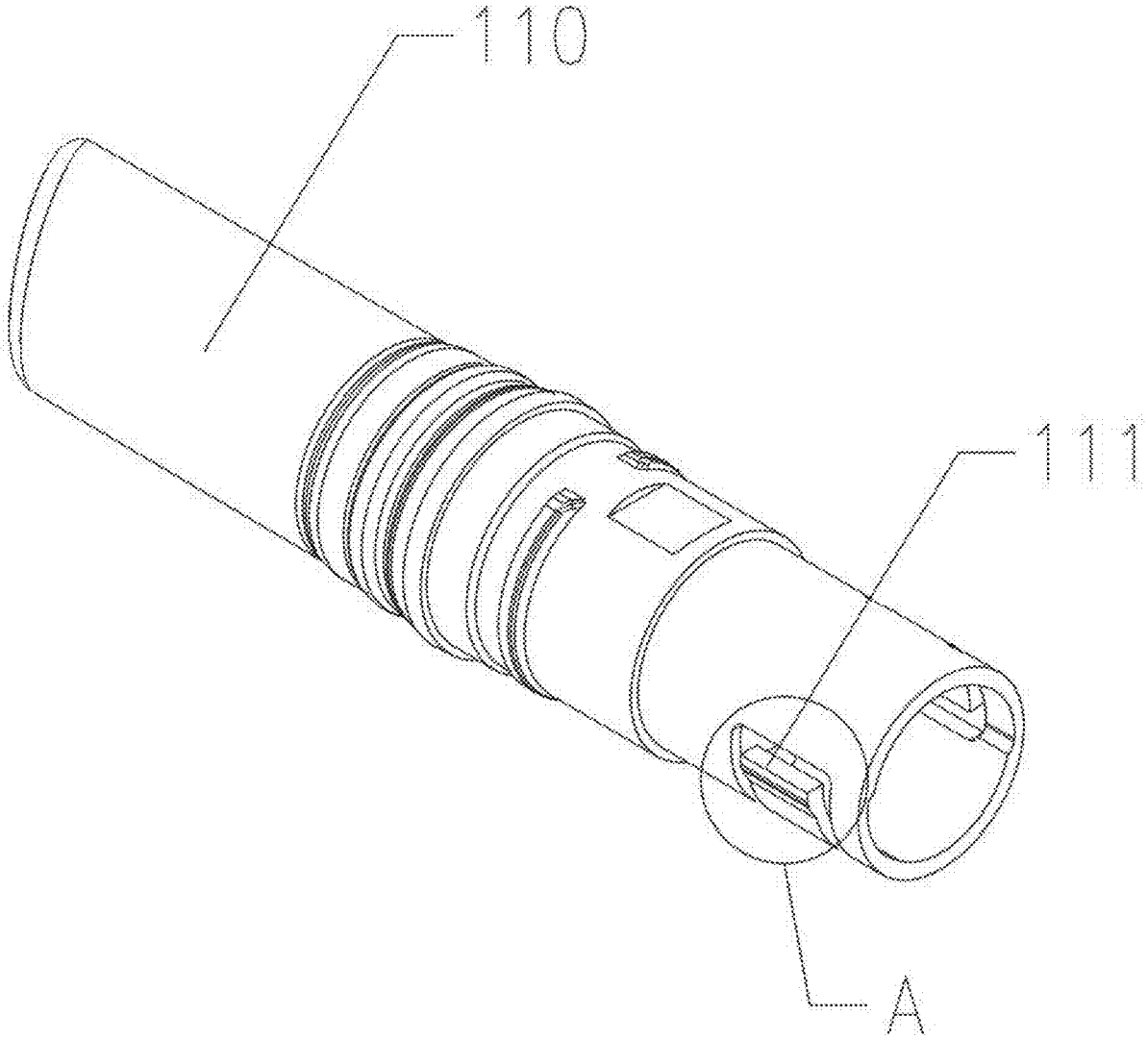
FIG. 5 is a schematic structural view of a sleeve according to the present disclosure.
Figure 6:
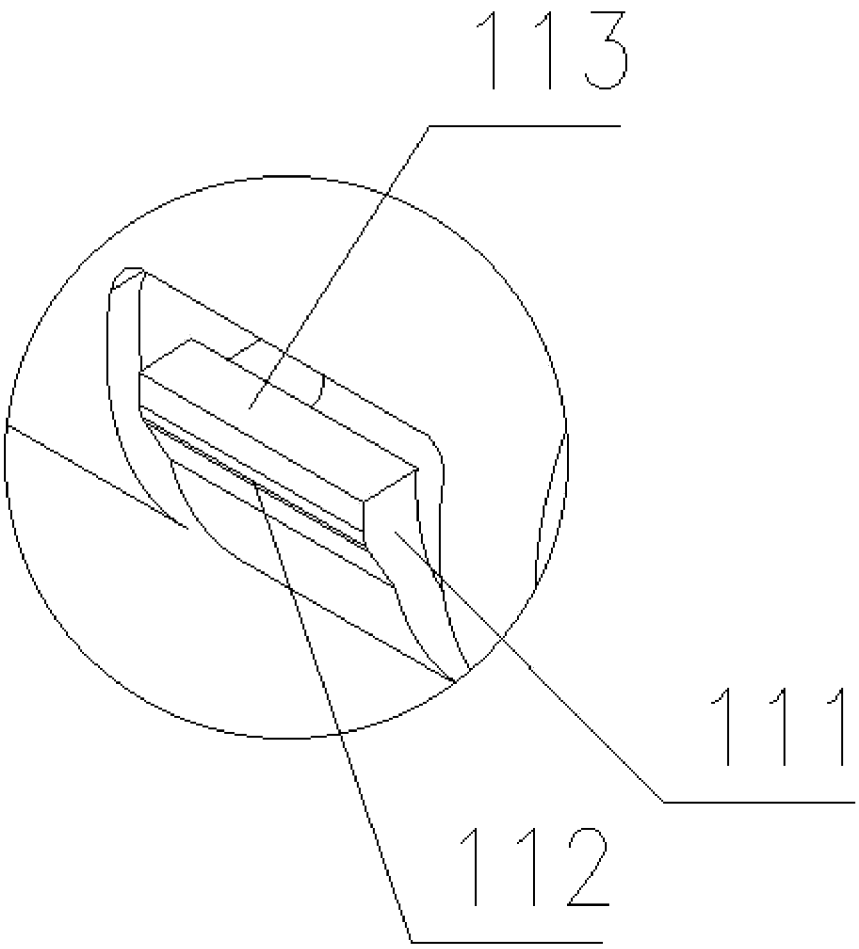
FIG. 6 is an enlarged view of A in FIG. 5.
Figure 14:
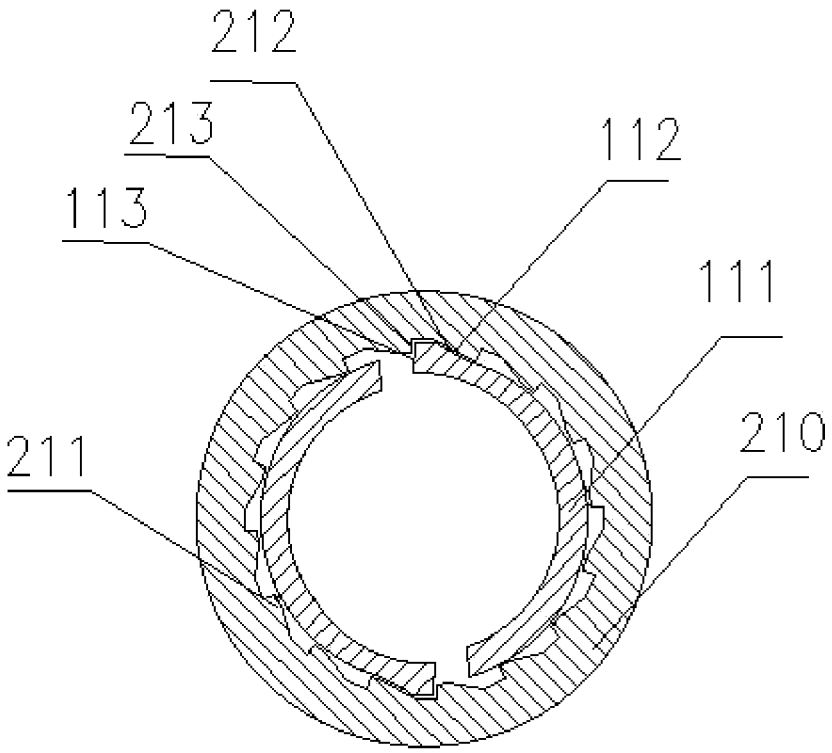
FIG. 14 is a sectional view along B-B in FIG. 13.

As shown in FIG. 1, the body assembly 200 includes barrel 210 and coupling member 220 that are fixedly connected. The coupling member 220 is fixedly provided in the barrel 210. The coupling member 220 protrudes from a tail portion of the barrel 210. The drive assembly 400 is provided in the coupling member 220. The threaded rod 320 is provided in the drive assembly 400. As shown in FIG. 5 and FIG. 6, elastic tooth 111 is provided on the sleeve 110. First oblique surface 112 and first straight surface 113 are provided on the elastic tooth 111. As shown in FIG. 14, sawtooth 211 is provided on an inner peripheral wall of the barrel 210. Second oblique surface 212 and second straight surface 213 are provided on the sawtooth 211. The first oblique surface 112 can slide on the second oblique surface 212. The first straight surface 113 is stopped at the second straight surface 213.

As shown in FIG. 5, in a possible implementation, a mounting groove is formed in the sleeve 110. The elastic tooth 111 is provided in the mounting groove. A first end of the elastic tooth 111 is fixedly connected to the sleeve 110, and a second end of the elastic tooth 111 is a free end. Optionally, except that the first end of the elastic tooth 111 is fixedly connected to the sleeve 110, remaining portions of the elastic tooth are disconnected from the sleeve 110. Therefore, the elastic tooth 111 has a certain elasticity. As shown in FIG. 6, the first straight surface 113 is located at the second end of the elastic tooth 111, and the first oblique surface 112 is located on an outer surface of the elastic tooth 111. Optionally, two elastic teeth 111 are provided on the sleeve 110. The two elastic teeth 111 are symmetrically arranged along a central axis of the sleeve 110. A plurality of sequentially-connected sawteeth 211 are provided on the inner peripheral wall of the barrel 210. This can ensure a force balance of the sleeve 110 in rotation, and improve a user experience in operation.

As shown in FIG. 13 and FIG. 14, after the sleeve 110 is provided on the barrel 210, the first straight surface 113 abuts against the second straight surface 213, and the first oblique surface 112 is attached to the second oblique surface 212. When the sleeve 110 is rotated clockwise, the first oblique surface 112 slides smoothly from the second oblique surface 212 of the previous sawtooth 211 to the second oblique surface 212 of the next sawtooth 211 through the elasticity of the elastic tooth 111, and the first straight surface 113 abuts against the second straight surface 213 of the next sawtooth 211 again. Since the first straight surface 113 abuts against the second straight surface 213, the sleeve 110 cannot be rotated counterclockwise. This prevents the user from manually operating the sleeve in use to return the cosmetic material, and ensures the unidirectional discharge of the cosmetic material.

In another possible implementation, a plurality of sequentially-connected elastic teeth 111 are provided on the outer peripheral wall of the sleeve 110. A plurality of sequentially-connected sawteeth 211 are provided on the inner peripheral wall of the barrel 210. Through mutual cooperation between the plurality of elastic teeth 111 and the plurality of sawteeth 211, a unidirectional rotating function of the sleeve 110 can also be achieved.

Figure 7:
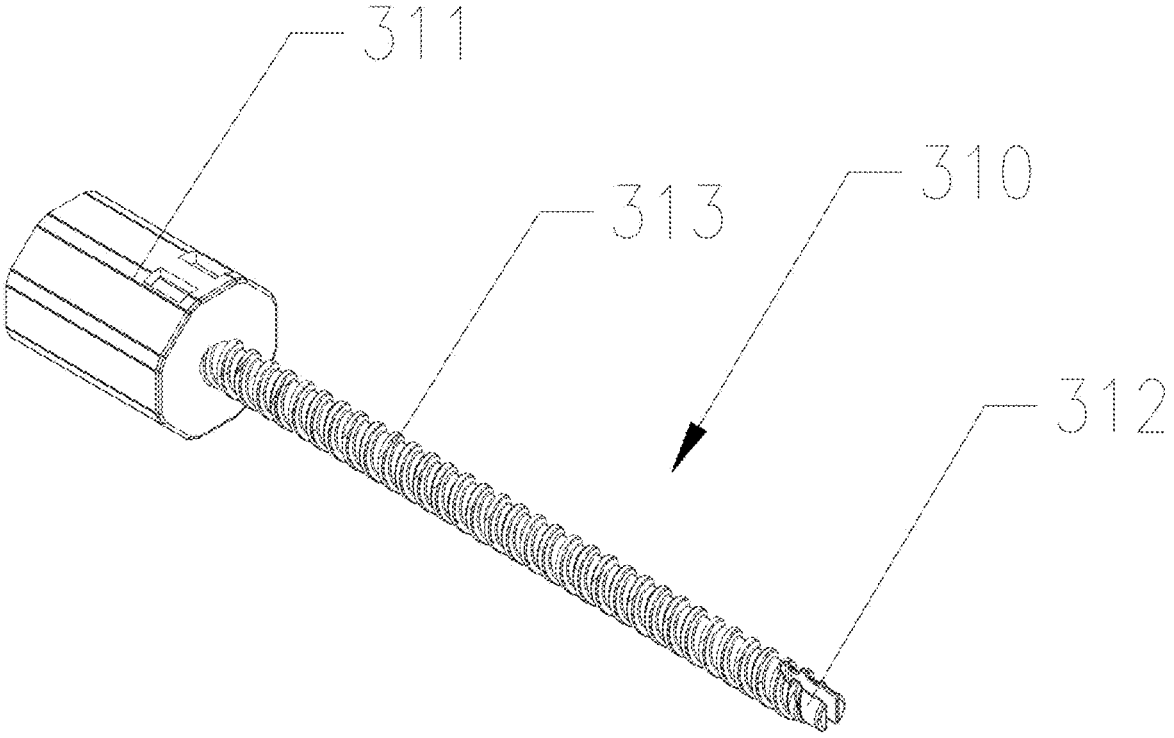
FIG. 7 is a schematic structural view of a material loading member according to the present disclosure.

As shown in FIG. 7, the material loading member 310 includes material loading cylinder 311 and connecting rod 312 fixed on the material loading cylinder 311. The material loading cylinder 311 is circumferentially fixed and axially movable in the sleeve 110. The connecting rod 312 is threadedly connected to the threaded rod 320. The structure in which the material loading cylinder 311 is circumferentially fixed and axially movable in the sleeve 110 is as follows: An outer peripheral wall of the material loading cylinder 311 forms a non-cylindrical structure. An inner peripheral wall of the sleeve 110 is the same as the outer peripheral wall of the material loading cylinder 311 in shape. The non-cylindrical structure includes a polyhedron, a prism or other special-shaped structures. In this way, the sleeve 110 in rotation can drive the material loading cylinder 311 to rotate synchronously. Certainly, both the outer peripheral wall of the material loading cylinder 311 and the inner peripheral wall of the sleeve 110 may also be designed as a cylindrical structure, and rotate synchronously through a convex rub or a groove.

Figure 8:
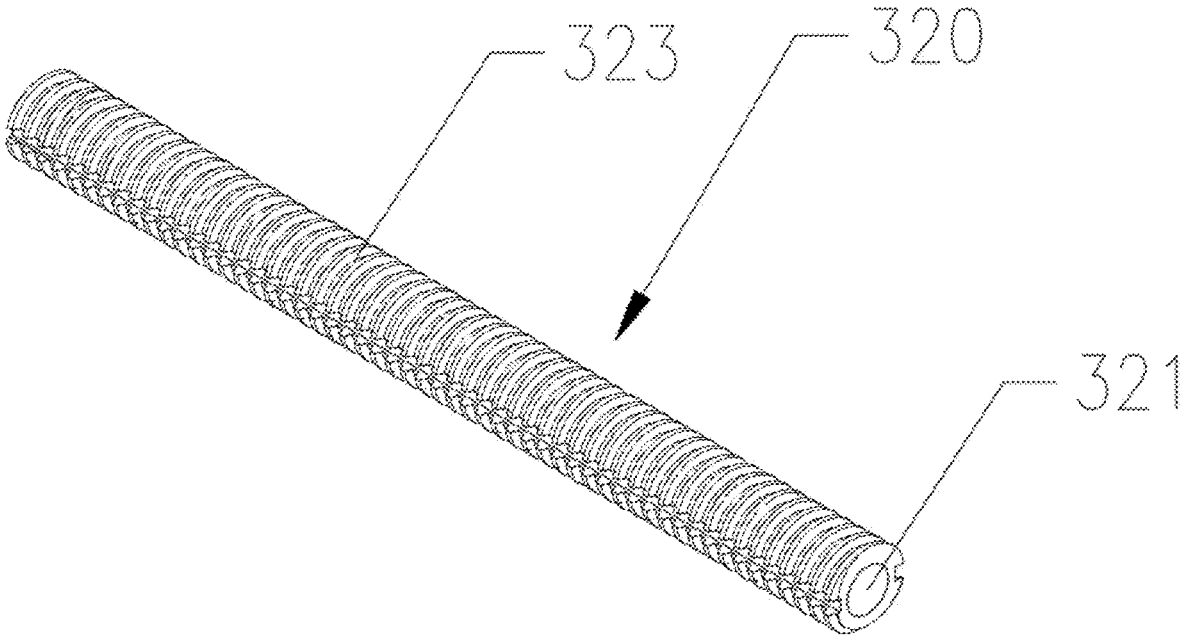
FIG. 8 is a schematic structural view of a threaded rod according to the present disclosure.
Figure 15:
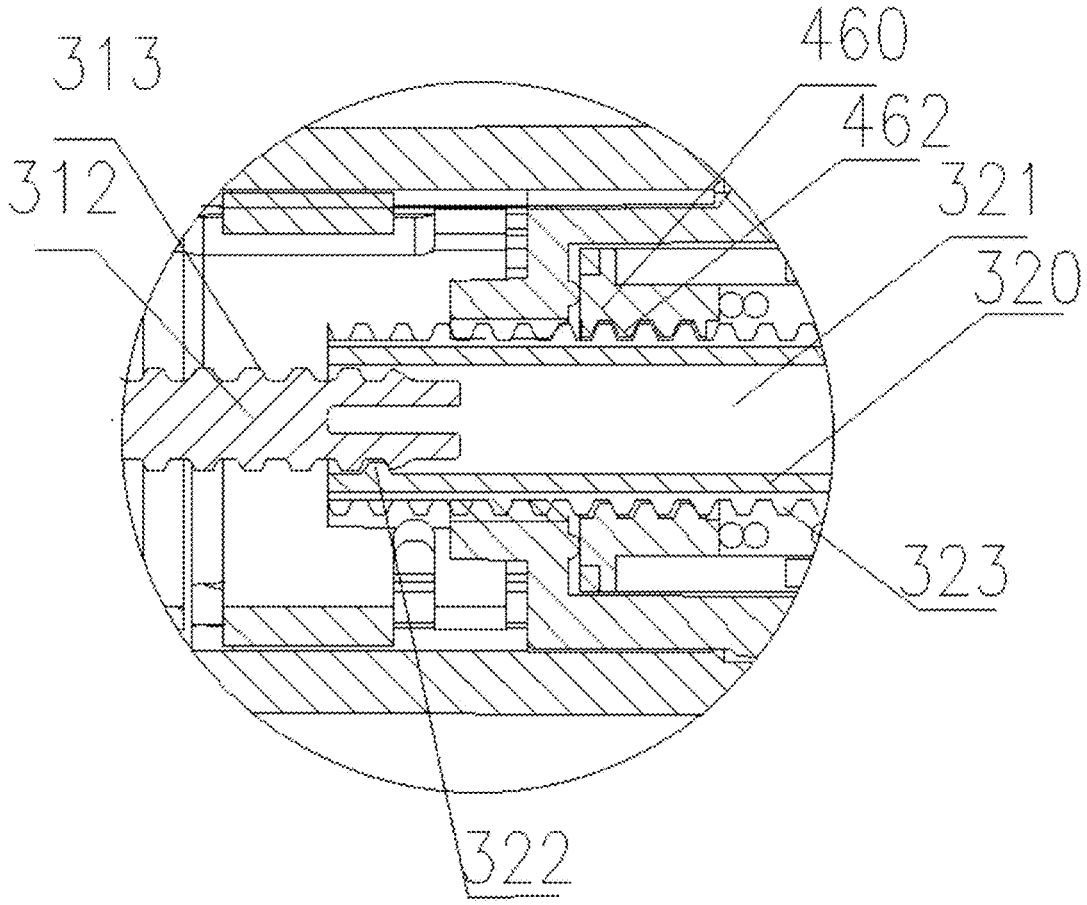
FIG. 15 is an enlarged view of C in FIG. 13.

As shown in FIG. 7, FIG. 8 and FIG. 15, an outer peripheral wall of the connecting rod 312 is provided with first external thread 313. Cavity 321 is formed in the threaded rod 320. An inner peripheral wall of the threaded rod 320 is provided with first internal thread 322, and an outer peripheral wall of the threaded rod 320 is provided with second external thread 323. The connecting rod 312 is inserted into the cavity 321. The first external thread 313 cooperates with the first internal thread 322. As shown in FIG. 13 and FIG. 15, an end of the threaded rod 320 close to the sleeve 110 is provided with the first internal thread 322. Initially, a tail end of the connecting rod 312 is inserted into the cavity 321 of the threaded rod 320, and the material loading cylinder 311 is close to the open end of the sleeve 110. Upon completion of the filling, namely after the cosmetic material 330 such as the lipstick is inserted into the material loading cylinder 311, the sleeve 110 is rotated. The sleeve 110 drives the material loading member 310 to rotate. Meanwhile, under an action of the first external thread 313 and the first internal thread 322, the connecting rod 312 moves toward a deep place of the cavity 321, until the connecting rod 312 enters the cavity 321 entirely, and the cosmetic material 330 completely retracts into the sleeve 110.

Figure 16:
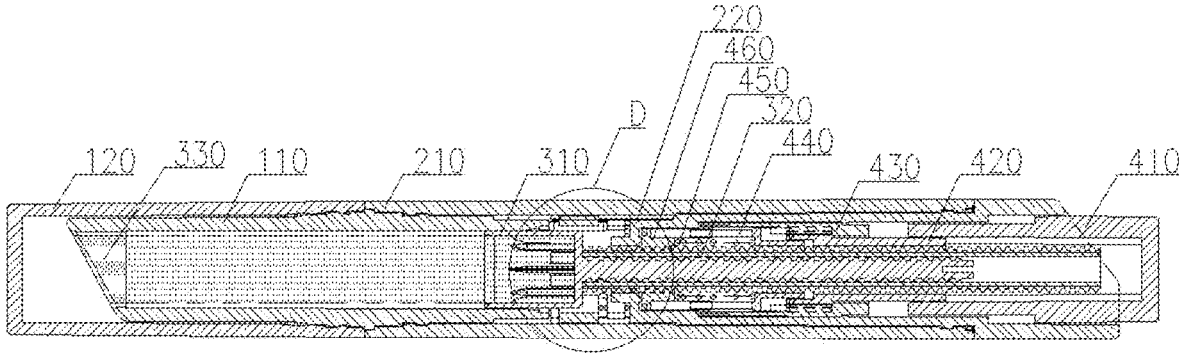
FIG. 16 is a schematic structural view after a makeup pen is filled according to the present disclosure.
Figure 17:
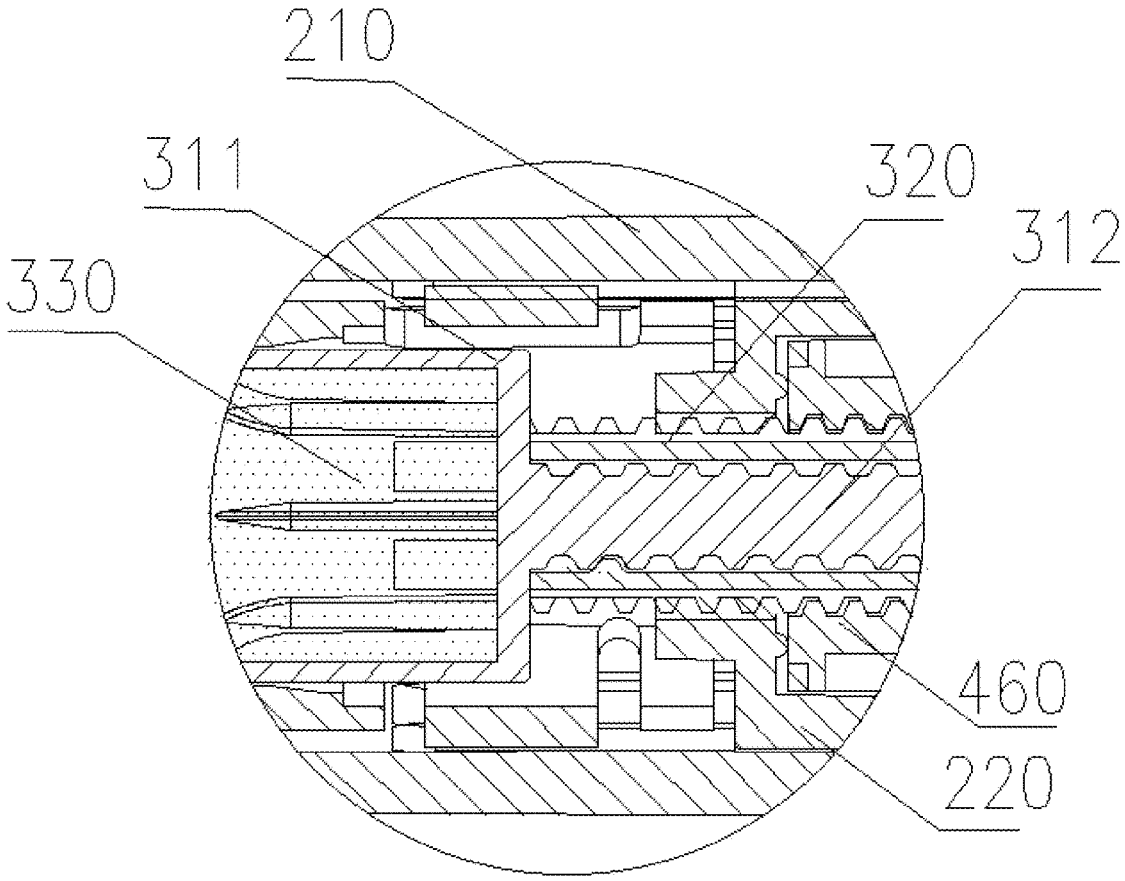
FIG. 17 is an enlarged view of D in FIG. 16.

As shown in FIG. 16 and FIG. 17, after the connecting rod 312 retracts into the threaded rod 320 completely, the threaded rod 320 abuts against a bottom of the material loading cylinder 311. In this way, the threaded rod 320 can drive the material loading member 310 to move synchronously, when moving away from the drive assembly 400 under an action of the drive assembly 400, thereby completing the discharge. The cosmetic material 330 cannot retracts to the sleeve 110 by rotating the sleeve 110 in use, thereby realizing the unidirectional discharge.

Figure 3:
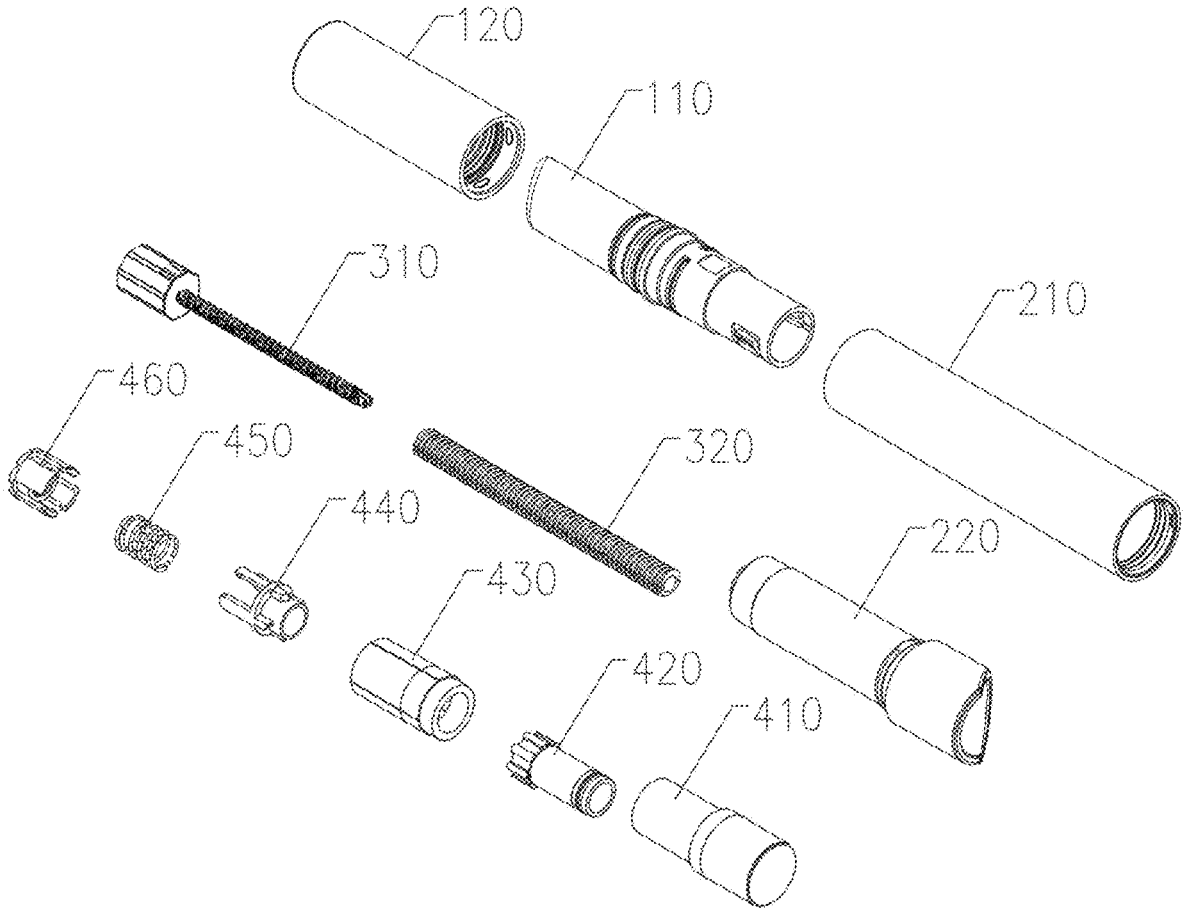
FIG. 3 is an exploded view of a makeup pen according to the present disclosure.

The drive assembly 400 can only drive the discharge assembly 300 to move away from the drive assembly 400. As shown in FIGS. 1-3, the drive assembly 400 includes button 410, ratchet 420, ratchet seat 430, ratchet wheel 440, elastic member 450, and rotating member 460. The ratchet 420 is fixedly provided in the button 410. The ratchet 420 and the ratchet wheel 440 are movably provided in the ratchet seat 430. The ratchet 420 is engaged with the ratchet wheel 440. The rotating member 460 is sleeved on the threaded rod 320 and threadedly connected to the threaded rod 320. The rotating member 460 abuts against the body assembly 200. As shown in FIG. 17, the rotating member 460 is provided in the coupling member 220. The rotating member abuts against the coupling member 220. As shown in FIG. 1, the elastic member 450 is provided between the rotating member 460 and the ratchet wheel 440. The ratchet 420 can drive the ratchet wheel 440 to rotate. The ratchet wheel 440 can drive the rotating member 460 to rotate, such that the rotating member 460 drives the threaded rod 320 to move away from the button 410.

As shown in FIG. 1, the coupling member 220 is fixedly provided in the barrel 210. The coupling member 220 protrudes from a rear end of the barrel 210. The ratchet seat 430 and the rotating member 460 are provided in the coupling member 220. The elastic member 450 includes a first end abutting against the rotating member 460, and a second end abutting against the ratchet wheel 440. The button 410 protrudes from the coupling member 220. In response to use, the button 410 is pressed. The button 410 drives the ratchet 420 and the ratchet wheel 440 to move synchronously toward the rotating member 460. The elastic member 450 is compressed. The button 410 drives the ratchet wheel 440 through the ratchet 420 to rotate. The ratchet wheel 440 drives the rotating member 460 to rotate. The rotating member 460 drives the threaded rod 320 and the material loading member 310 to move synchronously along the axial direction of the sleeve 110, so as to realize the unidirectional discharge. By pressing the button 410 once, a small amount of the cosmetic material 330 is driven by the threaded rod 320 to extend for use. This facilitates control on a discharge amount, without pollution and waste of the material. After the button 410 is released, under an action of the elastic member 450, the button 410, the ratchet 420 and the ratchet wheel 440 are restored for a next pressing operation.

Figure 4:
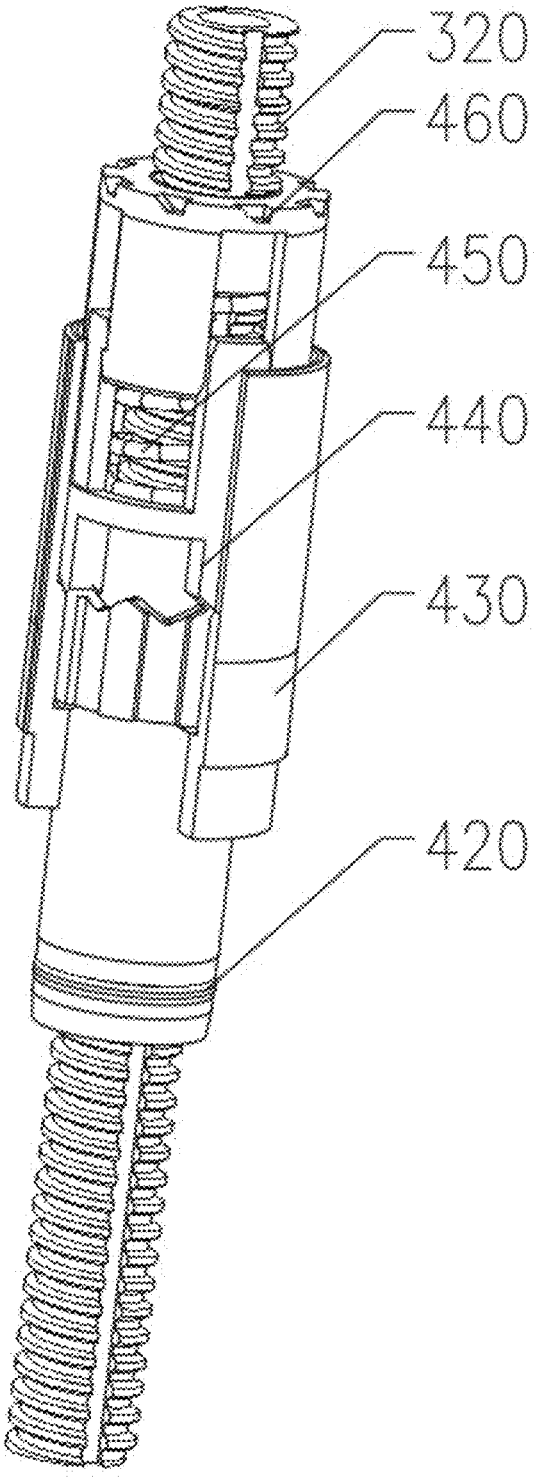
FIG. 4 is a partial structural view of a makeup pen according to the present disclosure.
Figure 9:
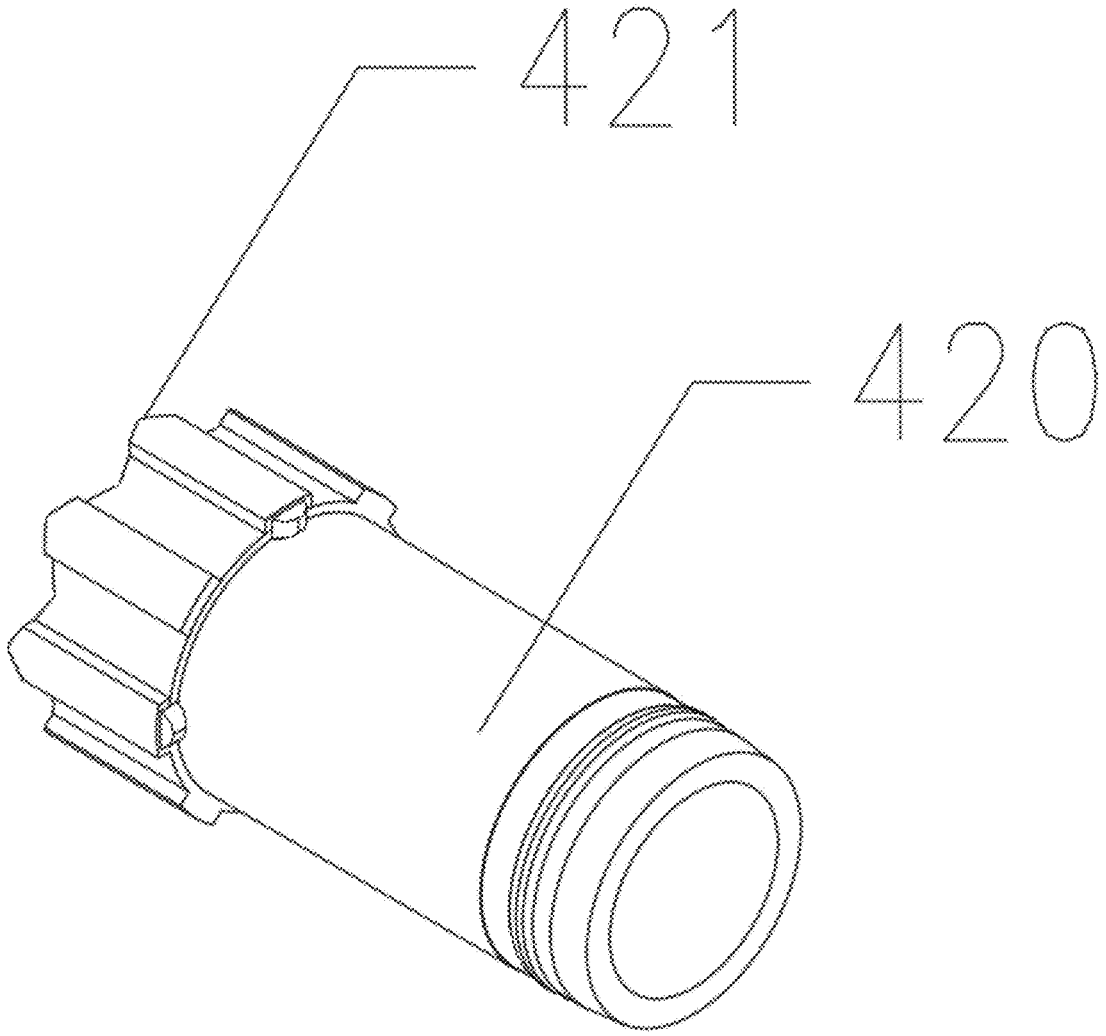
FIG. 9 is a schematic structural view of a ratchet according to the present disclosure.
Figure 10:
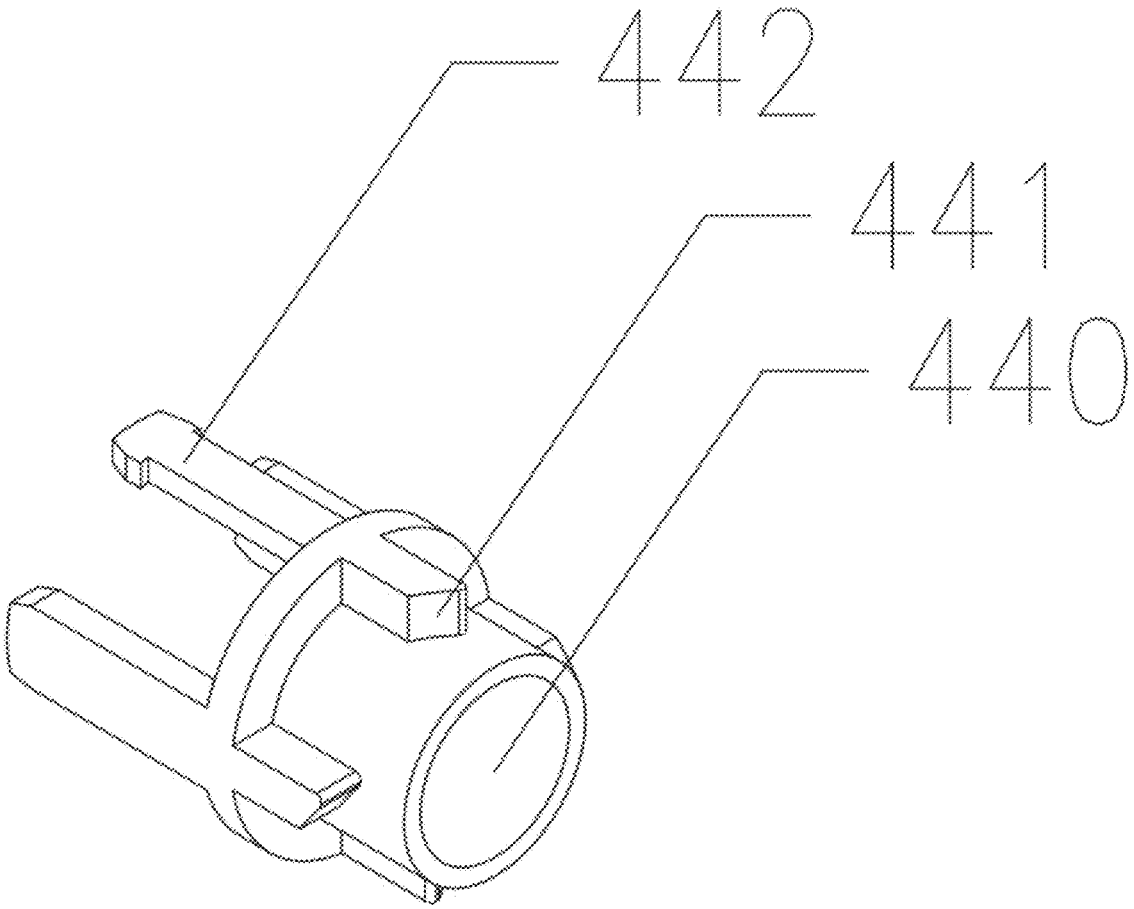
FIG. 10 is a schematic structural view of a ratchet wheel according to the present disclosure.
Figure 11:
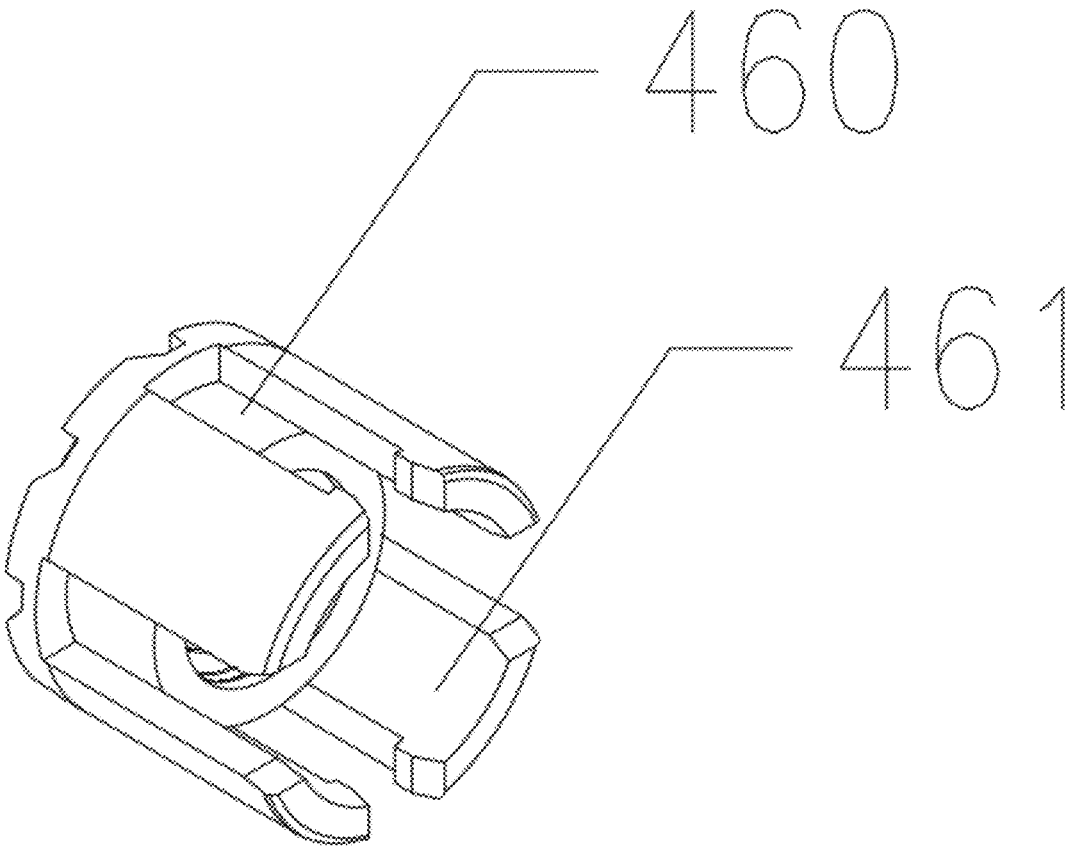
FIG. 11 is a schematic structural view of a rotating member according to the present disclosure.
Figure 12:
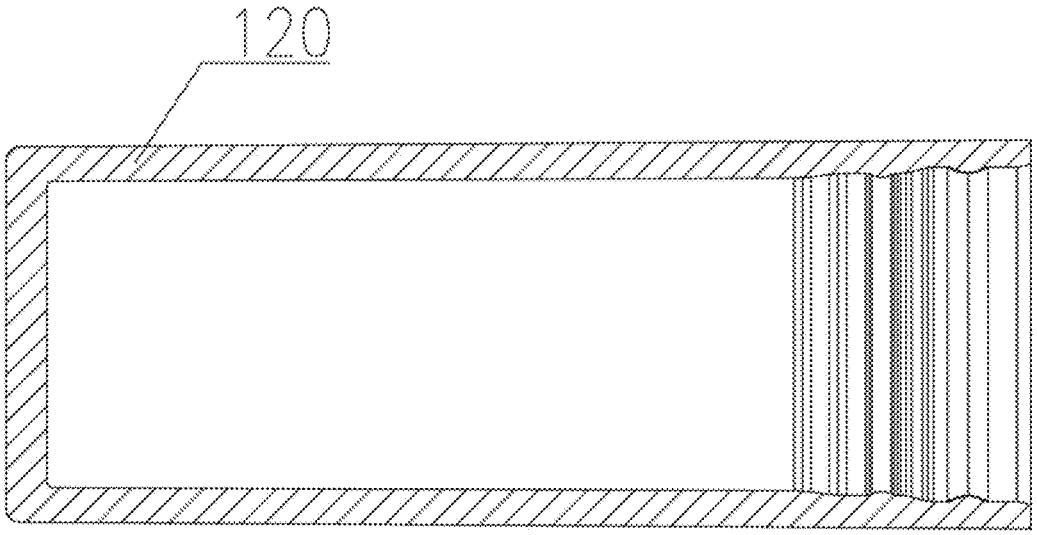
FIG. 12 is a schematic structural view of a cap according to the present disclosure.

As shown in FIG. 9, a first latch 421 is provided on the ratchet 420. As shown in FIG. 10, a second latch 441 and a first pawl 442 are provided on the ratchet wheel 440. As shown in FIG. 4, FIG. 11 and FIG. 15, a second pawl 461 is provided on the rotating member 460. An inner peripheral wall of the rotating member 460 is provided with second internal thread 462. The first latch 421 is engaged with the second latch 441. A gap is formed between two adjacent first pawls 442. The second pawl 461 is inserted into the gap to realize synchronous rotation of the rotating member 460 and the racket wheel 440. The rotating member 460 is sleeved on the threaded rod 320. The second internal thread 462 on the rotating member 460 cooperates with the second external thread 323 on the threaded rod 320. In the present disclosure, the rotating member 460 drives the threaded rod 320 to move. The rotating member 460 in movement only rotates, and does not move along the axial direction of the threaded rod 320, thereby simplifying the structure of the rotating member and the threaded rod.

According to the present disclosure, before the filling, as shown in FIGS. 12-15, after components of the makeup pen except the cap 120 are assembled, the tail end of the connecting rod 312 is inserted into the cavity 321 of the threaded rod 320. The material loading cylinder 311 is close to the open end of the sleeve 110. The first external thread 313 cooperates with the first internal thread 322. After the cosmetic material 330 is inserted into the material loading cylinder 311, the sleeve 110 is rotated. The sleeve 110 drives the material loading member 310 to rotate. Meanwhile, under an action of the first external thread 313 and the first internal thread 322, the connecting rod 312 moves toward a deep place of the cavity 321, until the connecting rod 312 enters the cavity 321 entirely. As shown in FIG. 16 and FIG. 17, the cosmetic material 330 completely retracts into the sleeve 110, the connecting rod 312 completely retracts into the threaded rod 320, and the threaded rod 320 abuts against the bottom of the material loading cylinder 311. The cap 120 is sleeved on the sleeve 110.

Figure 18:
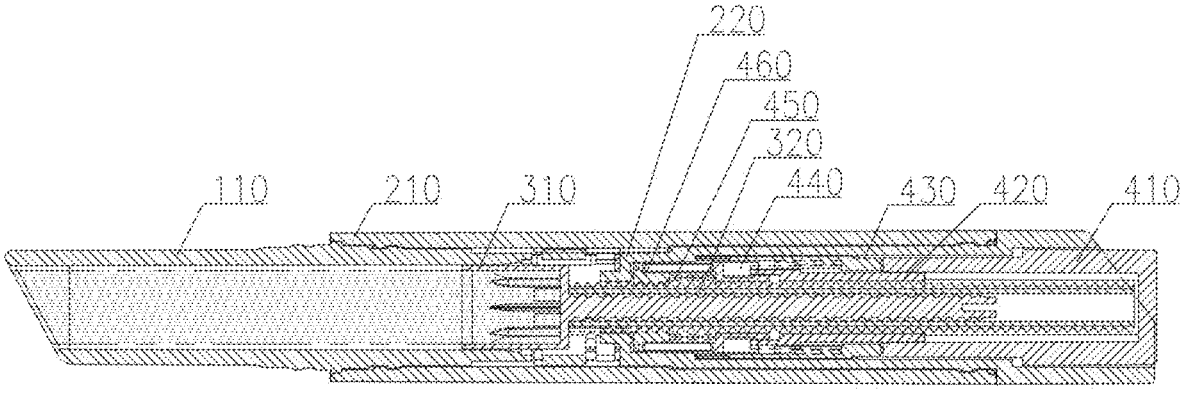
FIG. 18 is a schematic structural view after a makeup pen is pressed according to the present disclosure.
Figure 19:
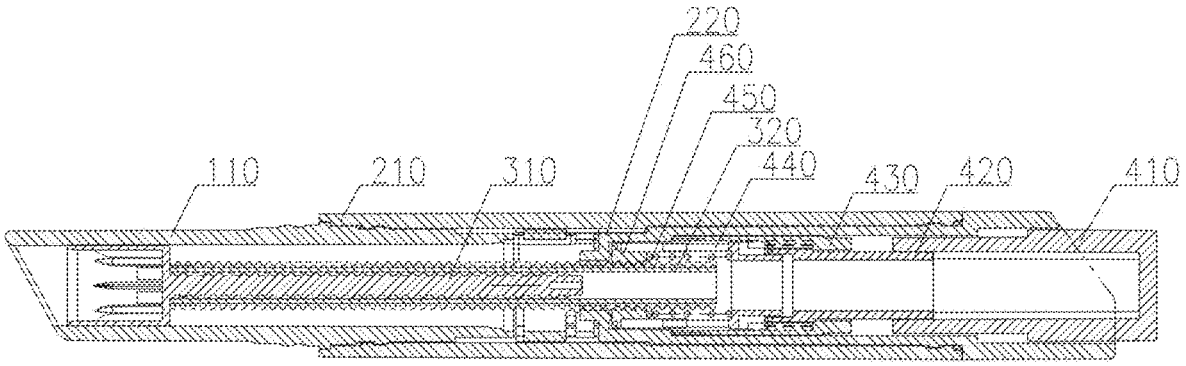
FIG. 19 is a schematic structural view after a makeup pen is used according to the present disclosure.

In response to use, the button 410 on the tail portion of the makeup pen is pressed. The button 410 drives the ratchet 420 and the ratchet wheel 440 to move synchronously toward the rotating member 460. The elastic member 450 is compressed. The button 410 drives the ratchet wheel 440 through the ratchet 420 to rotate. The ratchet wheel 440 drives the rotating member 460 to rotate. The rotating member 460 drives the threaded rod 320 and the material loading member 310 to move synchronously along the axial direction of the sleeve 110, so as to realize the unidirectional discharge. By pressing the button 410 once, a small amount of the cosmetic material 330 is driven by the threaded rod 320 to extend for use. After the button 410 is released, under an action of the elastic member 450, the button 410, the ratchet 420 and the ratchet wheel 440 are restored for a next pressing operation. FIG. 18 illustrates a state in which the button 410 is pressed. FIG. 19 illustrates a state in which the cosmetic material is used up, and the material loading member 310 and the threaded rod 320 move synchronously to the sleeve 110.

It should be noted that a person of ordinary skill in the art can further make variations and improvements without departing from the conception of the present disclosure. These variations and improvements all fall within the protection scope of the present disclosure. Therefore, the protection scope of the present disclosure shall be subject to the appended claims.

The invention claimed is:

1. A press-type makeup pen, comprising a nib assembly, a body assembly, a discharge assembly, and a drive assembly, wherein the nib assembly comprises a sleeve; the discharge assembly comprises a material loading member and a threaded rod; the sleeve is rotatably provided in the body assembly; the drive assembly is provided in the body assembly; the material loading member is threadedly connected to the threaded rod; the threaded rod is threadedly connected to the drive assembly; the sleeve is configured to drive the material loading member to rotate synchronously, such that the material loading member moves along an axial direction of the threaded rod to retract into the threaded rod; and the drive assembly is configured to drive the threaded rod to move toward a free end of the sleeve along an axial direction of the sleeve; and the sleeve is unidirectionally rotatable in the body assembly.

2. The press-type makeup pen according to claim 1, wherein the sleeve is axially fixed in the body assembly; and the sleeve is configured to drive the material loading member to move toward the drive assembly.

3. The press-type makeup pen according to claim 1, wherein the body assembly comprises a barrel and a coupling member, wherein the barrel and the coupling member are fixedly connected; an elastic tooth is provided on the sleeve; a first oblique surface and a first straight surface are provided on the elastic tooth; a sawtooth is provided on an inner peripheral wall of the barrel; a second oblique surface and a second straight surface are provided on the sawtooth; the first oblique surface is configured to slide on the second oblique surface; and the first straight surface is stopped at the second straight surface.

4. The press-type makeup pen according to claim 3, wherein a mounting groove is formed in the sleeve; the elastic tooth is provided in the mounting groove; a first end of the elastic tooth is fixedly connected to the sleeve, and a second end of the elastic tooth is a free end; the first straight surface is located at the second end of the elastic tooth; and the first oblique surface is located on an outer surface of the elastic tooth.

5. The press-type makeup pen according to claim 1, wherein the material loading member comprises a material loading cylinder and a connecting rod fixed on the material loading cylinder; the material loading cylinder is circumferentially fixed and axially movable in the sleeve; and the connecting rod is threadedly connected to the threaded rod.

6. The press-type makeup pen according to claim 5, wherein an outer peripheral wall of the connecting rod is provided with a first external thread; a cavity is formed in the threaded rod; an inner peripheral wall of the threaded rod is provided with a first internal thread, and an outer peripheral wall of the threaded rod is provided with a second external thread; the connecting rod is inserted into the cavity; and the first external thread cooperates with the first internal thread.

7. The press-type makeup pen according to claim 5, wherein after the connecting rod retracts into the threaded rod completely, the threaded rod abuts against a bottom of the material loading cylinder.

8. The press-type makeup pen according to claim 1, wherein the drive assembly comprises a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet is configured to drive the ratchet wheel to rotate, and the ratchet wheel is configured to drive the rotating member to rotate, such that the rotating member drives the threaded rod to move away from the button.

9. The press-type makeup pen according to claim 8, wherein a first latch is provided on the ratchet; a second latch and a first pawl are provided on the ratchet wheel; a second pawl is provided on the rotating member; an inner peripheral wall of the rotating member is provided with a second internal thread; the first latch is engaged with the second latch; a gap is formed between two adjacent first pawls; and the second pawl is inserted into the gap to realize synchronous rotation of the rotating member and the racket wheel.

10. The press-type makeup pen according to claim 2, wherein the drive assembly comprises a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet is configured to drive the ratchet wheel to rotate, and the ratchet wheel is configured to drive the rotating member to rotate, such that the rotating member drives the threaded rod to move away from the button.

11. The press-type makeup pen according to claim 3, wherein the drive assembly comprises a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet is configured to drive the ratchet wheel to rotate, and the ratchet wheel is configured to drive the rotating member to rotate, such that the rotating member drives the threaded rod to move away from the button.

12. The press-type makeup pen according to claim 4, wherein the drive assembly comprises a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet is configured to drive the ratchet wheel to rotate, and the ratchet wheel is configured to drive the rotating member to rotate, such that the rotating member drives the threaded rod to move away from the button.

13. The press-type makeup pen according to claim 5, wherein the drive assembly comprises a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet is configured to drive the ratchet wheel to rotate, and the ratchet wheel is configured to drive the rotating member to rotate, such that the rotating member drives the threaded rod to move away from the button.

14. The press-type makeup pen according to claim 6, wherein the drive assembly comprises a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet is configured to drive the ratchet wheel to rotate, and the ratchet wheel is configured to drive the rotating member to rotate, such that the rotating member drives the threaded rod to move away from the button.

15. The press-type makeup pen according to claim 7, wherein the drive assembly comprises a button, a ratchet, a ratchet seat, a ratchet wheel, an elastic member, and a rotating member; the ratchet is fixedly provided in the button; the ratchet and the ratchet wheel are movably provided in the ratchet seat; the ratchet is engaged with the ratchet wheel; the rotating member is sleeved on the threaded rod and threadedly connected to the threaded rod; the rotating member abuts against the body assembly; the elastic member is provided between the rotating member and the ratchet wheel; the ratchet is configured to drive the ratchet wheel to rotate, and the ratchet wheel is configured to drive the rotating member to rotate, such that the rotating member drives the threaded rod to move away from the button.

16. The press-type makeup pen according to claim 10, wherein a first latch is provided on the ratchet; a second latch and a first pawl are provided on the ratchet wheel; a second pawl is provided on the rotating member; an inner peripheral wall of the rotating member is provided with a second internal thread; the first latch is engaged with the second latch; a gap is formed between two adjacent first pawls; and the second pawl is inserted into the gap to realize synchronous rotation of the rotating member and the racket wheel.

17. The press-type makeup pen according to claim 11, wherein a first latch is provided on the ratchet; a second latch and a first pawl are provided on the ratchet wheel; a second pawl is provided on the rotating member; an inner peripheral wall of the rotating member is provided with a second internal thread; the first latch is engaged with the second latch; a gap is formed between two adjacent first pawls; and the second pawl is inserted into the gap to realize synchronous rotation of the rotating member and the racket wheel.

* * * * *